US008431193B2

(12) United States Patent
Romano, Jr. et al.

(10) Patent No.: US 8,431,193 B2
(45) Date of Patent: Apr. 30, 2013

(54) INKJET RECORDING MEDIUM

(75) Inventors: Charles E. Romano, Jr., Wisconsin Rapids, WI (US); Leonard J. Schliesman, Jr., Wisconsin Rapids, WI (US); James P. Niemiec, Wisconsin Rapids, WI (US)

(73) Assignee: Newpage Corporation, Miamisburg, OH (US)

( * ) Notice: Subject to any disclaimer, the term of this patent is extended or adjusted under 35 U.S.C. 154(b) by 164 days.

(21) Appl. No.: 12/855,135

(22) Filed: Aug. 12, 2010

(65) Prior Publication Data

US 2011/0037818 A1 Feb. 17, 2011

Related U.S. Application Data

(60) Provisional application No. 61/233,313, filed on Aug. 12, 2009.

(51) Int. Cl.
*B41M 5/40* (2006.01)

(52) U.S. Cl.
USPC ..... 428/32.21; 428/32.24; 428/32.28; 428/32.3; 428/32.31; 428/32.32; 428/32.35; 428/32.38

(58) Field of Classification Search ..... 428/32.21, 428/32.24, 32.28, 32.3, 32.31, 32.32, 32.35, 428/32.38
See application file for complete search history.

(56) References Cited

U.S. PATENT DOCUMENTS

| | | | | |
|---|---|---|---|---|
| 1,941,001 | A | 12/1933 | Hansell | |
| 3,197,322 | A | 7/1965 | Maskal et al. | |
| 3,373,437 | A | 3/1968 | Sweet et al. | |
| 3,416,153 | A | 12/1968 | Hertz et al. | |
| 3,798,047 | A | 3/1974 | Delfosse | |
| 3,878,519 | A | 4/1975 | Eaton | |
| 4,346,387 | A | 8/1982 | Hertz | |
| 4,714,603 | A | 12/1987 | Vanderheiden | |
| 4,824,654 | A | 4/1989 | Ota et al. | |
| 5,120,365 | A | 6/1992 | Kogler | |
| 5,164,172 | A | 11/1992 | Katayama et al. | |
| 5,269,818 | A | 12/1993 | Kunesh et al. | |
| 5,296,002 | A | 3/1994 | Passaretti | |
| 5,320,897 | A | 6/1994 | Kondo et al. | |
| 5,332,564 | A | 7/1994 | Chapnerkar et al. | |
| 5,418,057 | A | 5/1995 | Kokiyoshi et al. | |
| 5,454,864 | A | 10/1995 | Whalen-Shaw | |
| 5,478,388 | A | 12/1995 | Gane et al. | |
| 5,676,746 | A | 10/1997 | Brown | |
| 5,731,034 | A | 3/1998 | Husband | |
| 5,846,382 | A | 12/1998 | Von Raven | |
| 5,861,209 | A | 1/1999 | Haskins et al. | |
| 5,879,442 | A * | 3/1999 | Nishiguchi et al. | 106/464 |
| 5,882,396 | A | 3/1999 | Hiorns | |
| 5,939,036 | A | 8/1999 | Porter et al. | |
| 6,071,336 | A | 6/2000 | Fairchild et al. | |
| 6,150,289 | A | 11/2000 | Chen et al. | |
| 6,156,286 | A | 12/2000 | Fortier et al. | |
| 6,207,258 | B1 | 3/2001 | Varnell | |
| 6,221,146 | B1 | 4/2001 | Fortier et al. | |
| 6,380,265 | B1 | 4/2002 | Pryor et al. | |
| 6,402,824 | B1 | 6/2002 | Freeman et al. | |
| 6,554,410 | B2 | 4/2003 | Jeanmaire et al. | |
| 6,630,229 | B1 | 10/2003 | Normington et al. | |
| RE38,301 | E | 11/2003 | Bleakley et al. | |
| 6,677,386 | B1 | 1/2004 | Giezen et al. | |
| 6,685,908 | B1 | 2/2004 | Yaniv | |
| 6,780,920 | B2 | 8/2004 | Chapman et al. | |
| 6,825,252 | B2 | 11/2004 | Helbling et al. | |
| 6,841,609 | B2 | 1/2005 | Chapman et al. | |
| 6,863,775 | B2 | 3/2005 | Bobsein et al. | |
| 6,921,430 | B2 | 7/2005 | Bloembergen et al. | |
| 7,014,893 | B2 | 3/2006 | Wicher et al. | |
| 7,285,586 | B2 | 10/2007 | Helbling et al. | |
| 7,393,571 | B2 | 7/2008 | Chapman et al. | |
| 7,452,592 | B2 | 11/2008 | Cowton | |
| 7,803,224 | B2 | 9/2010 | Schliesman et al. | |
| 2003/0099816 | A1 | 5/2003 | Liu et al. | |
| 2003/0180478 | A1 | 9/2003 | Fruge et al. | |
| 2003/0191226 | A1 | 10/2003 | Chapman et al. | |
| 2003/0203133 | A1 * | 10/2003 | Maekawa | 428/32.1 |
| 2004/0255820 | A1 | 12/2004 | Chen et al. | |

(Continued)

FOREIGN PATENT DOCUMENTS

| | | |
|---|---|---|
| EP | 1114735 | 7/2001 |
| EP | 2196320 | 6/2010 |

(Continued)

OTHER PUBLICATIONS

PCT, International Search Report and Written Opinion, International Application No. PCT/US2010/045259 (Oct. 18, 2010).
Dimmick, A.C., "Effects of Sheet Moisture and Calender Pressure on PCC and GCC Coated Papers," TAPPI Journal (Nov. 2007).
Press Release, Kodak Focuses on Delivering Offset Class Quality, Providing Scaleable Solutions with Inkjet Printing Systems (Jan. 17, 2008).
Product Information, "HYDRAFINE® Kaolin Clay," KaMin Performance Minerals (2009).
Product Information, "HYDRAGLOSS® 90 Kaolin Clay," KaMin Performance Minerals (2009).
Product Information, "SYLOJET® C30 Cationic Porous Silica Dispersion for Ink Jet and Other Functional Coatings," W.R. Grace & Co. (Mar. 26, 2009).
Svanholm, "An Experimental Study of Inkjet Receptive Coatings" (Nov. 15, 2004).
Svanholm, Eric., "Printability and Ink-Coating Interactions in Inkjet Printing", Faculty of Technology and Science Chemical Engineering, Dissertation, Karlstad University Studies, 2007:2.
"Formulation Guide for ECOSPHERE® Biolatex Binders," by EcoSynthetix Inc. (2010).

(Continued)

*Primary Examiner* — Betelhem Shewareged
(74) *Attorney, Agent, or Firm* — Thompson Hine, L.L.P.

(57) ABSTRACT

An inkjet recording medium and a coating composition for forming an inkjet recording medium. In accordance with one aspect of the present invention, an inkjet recording medium is disclosed comprising an inkjet-receptive coating on a paper substrate. The inkjet-receptive coating contains a synergistic combination of pigments and binder such that the inkjet recording medium exhibits improved inkjet print properties, particularly when printed with a high speed inkjet printer using pigmented inks. In accordance with certain aspects of the present invention, the inkjet recording medium further comprises a top coat of a multivalent metal salt which further enhances image quality of the inkjet printing.

25 Claims, No Drawings

U.S. PATENT DOCUMENTS

| | | | | |
|---|---|---|---|---|
| 2005/0003113 | A1 | 1/2005 | Chen et al. | |
| 2006/0054291 | A1 | 3/2006 | Dimmick et al. | |
| 2006/0060317 | A1 | 3/2006 | Roding et al. | |
| 2006/0098066 | A1 | 5/2006 | Bauer | |
| 2006/0099408 | A1 | 5/2006 | Andersson et al. | |
| 2006/0102304 | A1 | 5/2006 | Nutbeem et al. | |
| 2006/0112855 | A1 | 6/2006 | Andersson et al. | |
| 2006/0137574 | A1 | 6/2006 | Preston et al. | |
| 2006/0159910 | A1 | 7/2006 | Song et al. | |
| 2006/0272549 | A1 | 12/2006 | Mathur et al. | |
| 2006/0292305 | A1 | 12/2006 | Skuse et al. | |
| 2007/0237909 | A1 | 10/2007 | McManus | |
| 2008/0008846 | A1 | 1/2008 | Zhou et al. | |
| 2008/0032074 | A1 | 2/2008 | Doi et al. | |
| 2008/0268185 | A1 | 10/2008 | Chen et al. | |
| 2009/0035478 | A1* | 2/2009 | Zhou et al. | 427/466 |
| 2009/0074995 | A1 | 3/2009 | Dannhauser et al. | |
| 2009/0087568 | A1 | 4/2009 | Kobayashi | |
| 2009/0123675 | A1 | 5/2009 | Shaw-Klein et al. | |
| 2009/0131570 | A1 | 5/2009 | Schliesman et al. | |
| 2009/0169455 | A1 | 7/2009 | Van Aert et al. | |
| 2011/0050827 | A1 | 3/2011 | Romano, Jr. et al. | |
| 2011/0069106 | A1 | 3/2011 | Song et al. | |
| 2012/0154502 | A1 | 6/2012 | Romano, Jr. et al. | |
| 2012/0212555 | A1 | 8/2012 | Romano, Jr. | |

FOREIGN PATENT DOCUMENTS

| | | | |
|---|---|---|---|
| WO | 03/031191 | A2 | 4/2003 |
| WO | 03/031191 | A3 | 4/2003 |
| WO | 2004/061014 | | 7/2004 |
| WO | 2006/116878 | | 11/2006 |
| WO | 2007/112013 | | 10/2007 |
| WO | 2009/095697 | | 8/2009 |
| WO | 2010/065750 | | 6/2010 |
| WO | 2010/114560 | | 10/2010 |
| WO | 2011/026070 | | 3/2011 |
| WO | 2012/083015 | | 6/2012 |

* cited by examiner

INKJET RECORDING MEDIUM

CROSS REFERENCE TO RELATED APPLICATION

This application claims the benefit of U.S. Provisional App. Ser. No. 61/233,313 filed Aug. 12, 2009, the contents of which are hereby incorporated by reference.

BACKGROUND OF THE INVENTION

The present application relates to an inkjet recording medium and a coating composition for forming an inkjet recording medium. More specifically, the inkjet recording medium disclosed herein is particularly useful for high speed multi-color printing such as high speed inkjet printing.

Traditionally, commercial printing presses printed catalogs, brochures and direct mail use offset printing. However, advances in inkjet technology have led to increased penetration into commercial print shops. Inkjet technology provides a high-quality alternative to offset printing for improving response rates, reducing cost, and increasing demand for products. In addition to printing high quality variable images and text, these printers incorporate a roll-fed paper transport system that enables fast, high-volume printing. Inkjet technology is now being used to for on-demand production of local magazines, newspapers, small-lot printing, textbooks, and transactional printing world wide.

Continuous inkjet systems are being developed that enable offset class quality, productivity, reliability and cost with the full benefits of digital printing for high volume commercial applications. These systems allow continuous inkjet printing to expand beyond the core base of transactional printers and secondary imprinting and into high volume commercial applications. Kodak's STREAM Inkjet technology is one example of such a system.

In accordance with certain aspects of the present invention, a recording medium is described which provides fast drying times, high gloss and excellent image quality when printed using high speed inkjet devices used in commercial printing applications.

U.S. Pat. App. Pub. No. 2009/0131570 entitled "Paper and Coating Medium for Multifunction Printing" (Schliesman, et al.) discloses an inkjet recording medium that is compatible with offset, inkjet, and laser printing. The formulation for this medium comprises an anionic primary pigment having a particle size distribution where at least 96% of the particles by weight have a particle size less than 2 microns; at least one cationic, grit free, secondary pigment having an average particle size of 3 microns or less; up to 17 weight % latex based on the weight of the dry pigments, wherein the latex is a hydrophilic styrene/butadiene latex; and a co-binder. While this formulation works well with many commercial inkjet printers, it performs poorly with the KODAK STREAM printer. The contents of the '570 publication are hereby incorporated by reference.

SUMMARY OF THE INVENTION

The present application describes an inkjet recording medium and a coating composition for forming an inkjet recording medium. In accordance with one aspect of the present invention, an inkjet recording medium is disclosed comprising an inkjet-receptive coating on a paper substrate. The inkjet-receptive coating contains a synergistic combination of pigments and binder such that the inkjet recording medium exhibits improved inkjet print properties, particularly when printed with a high speed inkjet printer using pigmented inks. In accordance with certain aspects of the present invention, the inkjet recording medium further comprises a top coat of a multivalent metal salt which further enhances image quality of the inkjet printing.

In accordance with certain embodiments, the paper coating includes a combination of a primary pigment and a secondary pigment. The primary pigment includes anionic particles having a particle size distribution where at least 96% of the particles by weight have a particle size less than 2 microns. The secondary pigment is a cationic, grit-free pigment having an average particle size of 3 microns or less. The coating also includes a binder and, optionally, a co-binder.

Aragonite is a particularly useful precipitated calcium carbonate that differs from other forms of calcium carbonate in both particle shape and size distribution. It is particularly useful as the primary pigment. Aragonite has a needle-like structure and a narrow particle size distribution making it particularly suitable as the primary pigment. While not wishing to be bound by theory, it is believed that the structure discourages tight particle packing of the pigment and provides the porosity needed for good ink absorption from different printing techniques. Use of the aragonite form produces a surface on the treated paper having a controlled porosity that allows it to perform well with any printing process.

Another embodiment of this invention relates to a coated sheet that includes a paper substrate to which the above coating has been applied. The coated sheet is highly absorbent for many types of ink. It quickly absorbs ink from several passes of an ink jet printer.

The coating and coated paper of the instant invention are particularly useful with pigmented ink jet inks. Limited use of the secondary cationic pigment allows some interaction between the cationic particles and the anionic binder and primary pigment that opens the pores and improves the porosity of the coating. When third and subsequent layers of ink are applied, the vehicle is able to be uniformly absorbed by the coating, even when pigmented inks are used.

DETAILED DESCRIPTION OF THE INVENTION

The coating for producing the inkjet recording medium typically includes at least two pigments, a primary pigment and a secondary pigment. The primary pigment may be a narrow particle size distribution, precipitated, anionic pigment. The secondary pigment may be a cationic pigment. The pigments typically are inorganic pigments. Further, the coating typically includes a binder and a co-binder. Pigments typically comprise the largest portion of the coating composition on a dry weight basis. Unless otherwise noted, amounts of component materials are expressed in terms of component parts per 100 parts of total pigment on a weight basis.

The primary component of the coating may be an anionic pigment having a narrow particle size distribution where 96% of the particles are less than 2 microns in diameter. Preferably, at least 80% by weight of the particles should be less than 1 micron and fall within the range of 0.1-1μ. In another embodiment, the distribution has at least 85% of the particles less than 1 micron and fall in the range of 0.1-1 microns. In another embodiment, 98% of the particles are less than 2 microns in diameter. Yet another embodiment uses a calcium carbonate wherein about 98% of the particles fall in the range of 0.1-1.0 microns. In accordance with certain embodiments, the primary pigment is from about 65 to about 85 parts, more particularly from about 70 to about 80 parts, of the total pigment by weight.

Calcium carbonate is useful as the primary pigment in any form, including aragonite, calcite or mixtures thereof. Calcium carbonate typically makes up 65-85 parts of the coating pigment on a dry weight basis. In certain embodiments, the calcium carbonate is from about 70 to 80 parts of the pigment weight. Aragonite is a particularly useful calcium carbonate. An advantage to using aragonite as the primary pigment is that the porous structure of the coating better withstands calendering to give it a gloss finish. When other forms of calcium carbonate are used in coatings, surface pores can be compacted so that some absorbency can be lost before a significant amount of gloss is achieved. A particularly useful aragonite is Specialty Minerals OPACARB A40 pigment (Specialty Minerals, Inc., Bethlehem, Pa.). A40 has a particle size distribution where 99% of the particles have a diameter of from about 0.1 to about 1.1 microns.

For the primary pigment, an alternate calcium carbonate having a narrow particle size distribution is OMYA Cover-Carb85 ground calcite calcium carbonate (OMYA AG, Oftringen, Switzerland). It provides the porous structure for successful ink absorption but less paper gloss development. This calcium carbonate, in accordance with certain embodiments, has a particle size distribution where 99% of the particles have a diameter less than 2 microns.

The secondary pigment typically is a cationic pigment. It is added to the coating which, when fully assembled, typically has an overall anionic nature. Attractive forces between the anionic coating and cationic pigment are believed to open up surface pores in the coating, increasing the porosity and the ink absorption rate. Ink drying times are also reduced. Additionally, since the ionic interaction is on a very small scale, the improved porosity is uniform over the coating surface.

The particle size distribution of the secondary pigment has an average particle size less than 3.0 microns and typically is grit-free. The term "grit-free" is intended to mean there are substantially no particles on a 325 mesh screen. In some embodiments, substantially all of the particles in the secondary pigment are sized at less than 1 micron. Amounts of the secondary pigment are typically less than 20 parts based on 100 parts by weight of the total pigment. Use of excessive cationic component may lead to undesirable ionic interaction and chemical reactions that can change the nature of the coating. The secondary pigment may be present in amounts greater than 5 parts cationic pigment per 100 total parts pigment. The secondary pigment may be present in amounts from about 7-13 parts, more particularly from about 10-12 parts. Examples of secondary pigments include carbonates, silicates, silicas, titanium dioxide, aluminum oxides and aluminum trihydrates. Particularly useful secondary pigments include cationic OMYAJET B and C pigments (OMYA AG, Oftringen, Switzerland).

Supplemental pigments are optional and may include anionic pigments used in the formulation as needed to improve gloss, whiteness or other coating properties. Up to an additional 30 parts by weight of the dry coating pigment may be an anionic supplemental pigment. Up to 25 parts, more particularly less than 20 parts, of the pigment may be a coarse ground calcium carbonate, another carbonate, plastic pigment, $TiO_2$, or mixtures thereof. An example of a ground calcium carbonate is Carbital 35 calcium carbonate (Imerys, Roswell, Ga.). Another supplemental pigment is anionic titanium dioxide, such as that available from Itochu Chemicals America (White Plains, N.Y.). Hollow spheres are particularly useful plastic pigments for paper glossing. Examples of hollow sphere pigments include ROPAQUE 1353 and ROPAQUE AF-1055 (Rohm & Haas, Philadelphia, Pa.). Higher gloss papers are obtainable when fine pigments are used that have a small particle size. The relative amounts of the supplemental pigments are varied depending on the whiteness and desired gloss levels.

A primary binder is added to the coating for adhesion. The primary binder may be anionic and in certain embodiments is a styrene/butadiene latex ("SBR Latex"). Optionally, the latex co-polymer also includes up to 20% by weight acrylonitrile repeating units. In accordance with certain embodiments, the SBR Latex may be a carboxylated styrene butadiene copolymer latex admixture and may contain acrylonitrile. Highly hydrophilic polymers may be used. Examples of useful polymers include Genflo 5915 SB Latex polymer, Genflo 5086 SB Latex polymer, Gencryl PT 9525 latex polymer, and Gencryl 9750 ACN Latex polymers (all available from RohmNova, Akron, Ohio). In accordance with yet other embodiments, the primary binder may be a starch such as those described below with respect to the use of starch as a co-binder. In accordance with certain embodiments, starch is the only binder in the coating composition. The total amount of primary binder typically is from about 2 to about 10, more particularly about 3 to about 8, and in certain cases from about 3.5 to about 5, parts per 100 parts of total pigments.

The coating may also include a co-binder that is used in addition to the primary binder. Examples of useful co-binders include polyvinyl alcohol and protein binders. The co-binder, when present, typically is used in amounts of about 1 to about 4 parts co-binder per 100 parts of pigment on a dry weight basis, more particularly from about 1.5 to 3 parts co-binder per 100 parts dry pigment. Another co-binder that is useful in some embodiments is starch. Both cationic and anionic starches may be used as a co-binder. ADM Clineo 716 starch is an ethylated cornstarch (Archer Daniels Midland, Clinton, Iowa). Penford PG 260 is an example of another starch co-binder that can be used. If a cationic co-binder is used, the amount used typically is limited so that the overall anionic nature of the coating is maintained. The binder levels should be carefully controlled. If too little binder is used, the coating structure may lack physical integrity, while if too much binder is used, the coating may become less porous resulting in longer ink drying times.

In accordance with certain embodiments, the primary binder and co-binder are present at a ratio of less than 2.5:1, more particularly less than 2.3:1 and in certain cases less than 2:1 (primary binder:co-binder by weight). These ratios are particularly suitable for formulation containing a latex polymer primary binder in combination with a starch co-binder.

In some embodiments of the invention, the coating is free of any additives that interfere significantly with the surface pore structure. Although starch is preferred from a cost perspective and its ability to improve surface smoothness, improved dry time performance may be obtained from starch free coatings. Starch also has a tendency to fill surface voids and eliminate surface pores. In some embodiments, the coating is free of starch. Still other embodiments are free of clay. In yet other embodiments, the coating may be free of titanium dioxide.

Other optional additives may be used to vary properties of the coating. Brightening agents, such as Clariant T26 Optical Brightening Agent, (Clariant Corporation, McHenry, Ill.) can be used. Insolubilizers or cross-linkers may be useful. A particularly useful cross-linker is Sequarez 755 (RohmNova, Akron, Ohio). A lubricant is optionally added to reduce drag when the coating is applied with a blade coater.

Conventional mixing techniques may be used in making this coating. If starch is used, it typically is cooked prior to preparing the coating using a starch cooker. In accordance with certain embodiments, the starch may be made down to approximately 35% solids. Separately, all of the pigments, including the primary pigment, secondary and any supplemental pigments, may be mixed for several minutes to ensure no settling has occurred. In the laboratory, the pigments may be mixed on a drill press mixer using a paddle mixer. The primary binder is then added to the mixer, followed by the co-binder 1-2 minutes later. If starch is used, it is typically added to the mixer while it is still warm from the cooker, approximately 190° F. The final coating is made by dispersion of the mixed components in water. Solids content of the dispersion typically is from about 55% to about 68% by weight. More particularly, the solids may be about 58% to about 62% of the dispersion by weight.

Yet another embodiment relates to an improved printing paper having a paper substrate to which the coating has been applied on at least one surface. Any coating method or apparatus may be used, including, but not limited to, roll coaters, jet coaters, blade coaters or rod coaters. The coating weight is typically about 2 to about 10, more particularly about 5 to about 8, pounds per 3300 ft.$^2$ per side, to size press, pre-coated or unsized base papers. Coated papers would typically range from about 30 lb. to about 250 lb./3300 ft.$^2$ of paper surface. The coated paper is then optionally finished as desired to the desired gloss.

The substrate or base sheet may be a conventional base sheet. Examples of useful base sheets include NewPage 60 lb. Web Offset base paper, Orion, and NewPage 105 lb. Satin Return Card Base Stock, both from NewPage Corporation (Wisconsin Rapids, Wis.).

The inkjet recording medium may also include a top coating comprising a multivalent metal salt. In certain embodiments of the invention, the multivalent metal is a divalent or trivalent cation. More particularly, the multivalent metal salt may be a cation selected from $Mg^{+2}$, $Ca^{+2}$, $Ba^{+2}$, $Zn^{+2}$, and $Al^{+3}$, in combination with suitable counter ions. Divalent cations such as $Ca^{+2}$ and $Mg^{+2}$ are particularly useful. Combinations of cations may also be used.

Examples of the salt used in the top coating include (but are not limited to) calcium chloride, calcium acetate, calcium nitrate, magnesium chloride, magnesium acetate, magnesium nitrate, magnesium sulfate, barium chloride, barium nitrate, zinc chloride, zinc nitrate, aluminum chloride, aluminum hydroxychloride, and aluminum nitrate. Similar salts will be appreciated by the skilled artisan. Particularly useful salts include $CaCl_2$, $MgCl_2$, $MgSO_4$, $Ca(NO_3)_2$, and $Mg(NO_3)_2$, including hydrated versions of these salts. Combinations of the salts may also be used. The top coating may also contain various additives as needed to provide the desirable properties for the top coating. For example, the top coating formulation may contain a rheology modifier. The coating weight for the top coating may be from about 0.15 to about 2.5 gsm, more particularly about 0.5 to about 2 gsm, per side.

The finished coated paper is useful for printing. Ink is applied to the coating to create an image. After application, the ink vehicle penetrates the coating and is absorbed therein. The number and uniformity of the coating pores result in even and rapid ink absorption, even when multiple layers of ink are applied. This coated paper may also be well suited for multifunctional printing, whereby an image on a coated paper media is created from combinations of dyes or pigmented inks from ink jet printers, toner from laser printers and inks from offset or gravure or flexo presses.

The following non-limiting examples illustrate specific aspects of the present invention.

A formulation comprising fine calcium carbonate (A-40 Aragonite, SMI Corporation), plastic pigment (Rhopaque 1353, Omnova), coarse calcium carbonate (Covercarb-35, Omya), cationic calcium carbonate (Omyajet-C, OMYA), starch (PG 260, Penford), styrene-butadiene latex (Gencryl PT 9525, Omnova), and crosslinker (Sequarez 755, Omnova) provides excellent dry time and image quality when printed with a Kodak 5300 printer. This printer simulates the performance observed with Kodak high speed STREAM printer. The image quality can be further enhanced by adding a multivalent metal salt as a top coat in a subsequent coating pass.

The formulations below were coated on 60# base paper manufactured at the NewPage, Wickliffe, Ky. mill by means of a blade coater at 6.5 lbs (per 3,300 ft.$^2$). The base paper used for this example typically contains a mixture of softwood and hardwood fibers. Softwood fibers typically are present in an amount of about 0-25% and hardwood fibers are present in an amount of about 100-75%. In accordance with a particularly useful base paper, the softwood and hardwood fibers are present in a ratio of 15% to 85%, respectively. The base paper typically includes from about 40-50 lb/ton size press starch and in particular embodiments about 45 lb/ton size press starch.

The ink jet receptive coatings were calendered at 1200 PLI/100° F. using 3 nips/side. A test target was printed on the resulting paper with a Kodak 5300 printer containing standard Kodak pigmented inks. The test target comprised Dmax black, magenta, cyan, yellow, red, green, and blue patches. Each patch was measured for mottle using a Personal IAS Image Analysis System manufactured by QEA. Mottle is a density non-uniformity that occurs at a low spatial frequency (i.e. noise at a coarse scale). The units of mottle are percent reflectance using the default density standard and color filter specified in the software. A lower mottle value indicates better performance. The mottle result below is the average of mottle of the black, magenta, cyan, yellow, red, green, and blue patches. In accordance with certain aspects of the present invention, mottle values of less than 2.0, more particularly less than 1.5, and in certain cases less than 1.0 can be obtained.

Comparative samples were also printed using the Kodak 5300 printer and evaluated in the same manner as the test samples. The control samples were prepared using Sterling Ultra Matte Text. Sterling Ultra Matte Text is a coated paper coated on both sides with a coating containing clay, calcium carbonate and a latex binder. The coat weights on each side typically are about 8-9 lbs/ream on a 62 lb. base sheet. for a coated sheet with a nominal weight of 80 lb.

The results in Table 1 show that the inventive example exhibits improved mottle compared to the comparative examples. Mottle can be further improved by top coating the finished paper with a 5% solution of $CaCl_2$. Again, the inventive example top coated with $CaCl_2$ has superior performance than the comparative examples top coated with $CaCl_2$. The divalent metal used in the top coating is not particularly limited. Examples of other divalent salts that can be used include salts of calcium or magnesium such as magnesium chloride and calcium hydroxide.

TABLE 1

| | Coating Formulations | | | | | |
|---|---|---|---|---|---|---|
| | Inv Ex 1 | Inv Ex 2 | Comp Ex 1 | Comp Ex 2 | Comp Ex 3 | Comp Ex 4 |
| | Material | | | | | |
| | Dry Parts | Dry Parts | Dry Parts | Dry Parts | Sterling Ultra Matte Text | Sterling Ultra Matte Text |
| A-40 Aragonite | 76 | 76 | 72 | 72 | | |
| Ropaque 1353 | 4 | 4 | 8 | 8 | | |
| Titanium Dioxide | | | 4 | 4 | | |
| Coarse Carb CC-35 | 9 | 9 | 7.5 | 7.5 | | |
| OMYA Jet C | 11 | 11 | 8.5 | 8.5 | | |
| PG 260 Starch | 2 | 2 | 3 | 3 | | |
| Gencryl 9525 Latex | 4 | 4 | 8 | 8 | | |
| Sequarez 755 | 0.5 | 0.5 | 0.5 | 0.5 | | |
| Coat Weight lbs | 6.5 | 6.5 | 6.5 | 6.5 | | |
| 5% $CaCl_2$ Top coat | No | Yes | No | Yes | No | Yes |
| Mottle | 1.21 | 0.85 | 2.22 | 1.30 | 3.84 | 1.39 |

TABLE 2

| Non-limiting Coating Formulation Examples | | | |
|---|---|---|---|
| Generic Material | Narrow Range Dry Parts | Broad Range Dry Parts | Example Material |
| Primary Pigment | 72-76 | 65-85 | A-40 |
| Supplemental Pigment | 2-8 | 1-10 | Rhopaque 1353 |
| Supplemental Pigment | 7-11 | 5-15 | Covercarb-35 |
| Secondary Pigment | 7-13 | 5-17 | OMYA Jet C |
| Co-Binder | 1.5-3 | 1-5 | PG 260 Starch |
| Binder | 3.5-5 | 2-10 | Gencryl PT 9525 |
| Crosslinker | 0.10-0.40 | 0.05-1.0 | Sequarez 755 |

What is claimed is:

1. An inkjet recording medium comprising:

a paper substrate; and an inkjet-receptive coating comprising a primary pigment, wherein the primary pigment is a needle-shaped aragonite having a particle size distribution where at least 96% of the particles by weight have a particle size less than 2 microns;

a secondary pigment having an average particle size of 3 microns or less;

from about 2 to 8 parts by weight of an anionic binder based on 100 parts total pigments and a co-binder wherein the binder and co-binder are present at a ratio of less than 2.5:1 (binder:co-binder by weight).

2. The inkjet recording medium of claim 1 wherein said medium has a mottle value of less than 2.0 when printed with a pigmented inkjet ink.

3. The inkjet recording medium of claim 1 wherein said coating is free of titanium dioxide.

4. The inkjet recording medium of claim 1 wherein said binder is an anionic hydrophilic styrene butadiene/acrylonitrile (SBA) copolymer latex.

5. The inkjet recording medium of claim 1 wherein said co-binder is selected from the group consisting of protein binders, polyvinyl alcohol, starch and mixtures thereof.

6. The inkjet recording medium of claim 1 wherein said primary pigment is present in an amount of about 65 to 85 parts based on 100 parts total pigments.

7. The inkjet recording medium of claim 1 wherein said coating further comprises a plastic pigment present in an amount of about 2 to 8 parts per 100 parts total pigments.

8. The inkjet recording medium of claim 1 wherein said coating is present at a coat weight of about 2 to 7 lbs./ream (3,300 $ft.^2$).

9. The inkjet recording medium of claim 1 further comprising a top coat comprising a multivalent metal salt.

10. The inkjet recording medium of claim 1 further comprising a top coat comprising a divalent metal salt.

11. The inkjet recording medium of claim 10 wherein the divalent metal salt comprises calcium chloride.

12. The inkjet recording medium of claim 6 further comprising a top coat comprising a divalent metal salt wherein the top coat is present at a coat weight of from about 0.15 to about 2.5 gsm.

13. The inkjet recording medium of claim 12 wherein the binder is present in an amount of about 3.5 to 5 parts by weight based on 100 parts total pigments.

14. The inkjet recording medium of claim 1 wherein the binder comprises an anionic hydrophilic styrene butadiene/acrylonitrile (SBA) copolymer latex and the co-binder is starch.

15. The inkjet recording medium of claim 14 wherein said latex and starch are present in a ratio of less than 2:1 (latex: starch by weight).

16. An inkjet recording medium comprising:

a paper substrate; and an inkjet-receptive coating comprising:

a primary pigment comprising needle-shaped aragonite having a particle size distribution where at least 96% of the particles by weight have a particle size less than 2 microns;

a secondary pigment having an average particle size of 3 microns or less; and a binder; and a top coat comprising a multivalent metal salt.

17. The inkjet recording medium of claim 16 wherein said medium has a mottle value of less than 2.0 when printed with a pigmented inkjet ink.

18. The inkjet recording medium of claim 16 wherein said binder is an anionic hydrophilic styrene butadiene/acrylonitrile (SBA) copolymer latex.

19. The inkjet recording medium of claim 16 wherein said coating further comprises a co-binder selected from the group consisting of protein binders, polyvinyl alcohol, starch and mixtures thereof.

20. The inkjet recording medium of claim 16 wherein said primary pigment is present in an amount of about 65 to 85 parts based on 100 parts total pigments.

21. The inkjet recording medium of claim 16 wherein said coating further comprises a plastic pigment present in an amount of about 2 to 8 parts per 100 parts total pigments.

22. The inkjet recording medium of claim 16 wherein said coating is present at a coat weight of about 2 to 7 lbs./ream (3,300 $ft.^2$).

23. The inkjet recording medium of claim 16 wherein the top coat comprises a divalent metal salt.

24. The inkjet recording medium of claim 23 wherein the divalent metal salt comprises calcium chloride.

25. The inkjet recording medium of claim 16 wherein the binder is present in an amount from about 2 to 10 parts by weight of a binder based on 100 parts total pigments.

* * * * *